US007259310B2

(12) United States Patent
Wilfer

(10) Patent No.: US 7,259,310 B2
(45) Date of Patent: Aug. 21, 2007

(54) WALL HOLDER FOR MUSICAL INSTRUMENT

(76) Inventor: Hans-Peter Wilfer, Zum Hackerhof 5, Markneukirchen (DE) D-08258

( * ) Notice: Subject to any disclaimer, the term of this patent is extended or adjusted under 35 U.S.C. 154(b) by 0 days.

(21) Appl. No.: 10/866,703

(22) Filed: Jun. 15, 2004

(65) Prior Publication Data

US 2004/0255753 A1 Dec. 23, 2004

(30) Foreign Application Priority Data

Jun. 17, 2003 (EP) ..... 03013708

(51) Int. Cl.
*G10D 3/00* (2006.01)

(52) U.S. Cl. ..... 84/327; 248/110

(58) Field of Classification Search ..... 84/327, 84/379; 248/110, 470, 95, 48.2; 269/81; 211/70.6

See application file for complete search history.

(56) References Cited

U.S. PATENT DOCUMENTS 5,165,629 A * 11/1992 Breveglieri ..... 248/110
5,301,823 A * 4/1994 Kingery ..... 211/85.6
5,499,724 A * 3/1996 Hickman ..... 211/70.6
6,281,417 B1 * 8/2001 Ladao ..... 84/327
6,323,406 B1 11/2001 Park ..... 84/327

FOREIGN PATENT DOCUMENTS

DE 195 07 681 A1 9/1996

* cited by examiner

*Primary Examiner*—Lincoln Donovan
*Assistant Examiner*—Jianchun Qin
(74) *Attorney, Agent, or Firm*—Akerman Senterfitt; Jean C. Edwards, Esq.

(57) ABSTRACT

The invention relates to a wall holder for at least one musical instrument having a neck or a similar taper, in particular a guitar or bass guitar, including a mounting which is fastened or can be fastened to the wall and at least two support elements which are arranged on the mounting can be inserted between those of the neck of the musical instrument, the neck and/or the head of the musical instrument abutting against the support elements, and is characterized in that the mounting has at least one guide bar bracket for the support elements via which the support elements can be moved relative to one another.

4 Claims, 4 Drawing Sheets

WALL HOLDER FOR MUSICAL INSTRUMENT

This application claims priority from European Patent Application No. 03 013 708.7, filed Jun. 17, 2003, the entire contents of which are herein incorporated by reference to the extent allowed by law.

BACKGROUND OF THE INVENTION

1. Field of the Invention

The invention relates to a wall holder for at least one musical instrument having a neck or similar taper, in particular a guitar or bass guitar.

2. Description of the Related Art

Musical instruments, in particular string instruments such as guitars, bass guitars and the like, are very sensitive to external mechanical influences. When the instruments are not being used, then they must be stored in such a way that the sensitive components do not come into contact with the wall, floor or other surfaces and generally prevent damage to the musical instruments, for example, due to tipping over or falling down.

For storing string instruments, numerous musical instrument stands are known in which the instruments can be placed and thus securely stored. If the guitars, bass guitars and the like are to be stored for longer periods of time, a wall holder is also available for musical instruments. In comparison to a musical instrument stand, a wall holder is very space-saving and the instruments are, moreover, also better protected against damage.

Wall holders for guitars, bass guitars and the like are known in various embodiments. A known embodiment of a wall holder is a rack in which the string instrument can be placed upright or laid down and which supports the string instrument both at the neck or at the head or even on the body in a suitable manner. In a string instrument, the neck is generally designated as that area which carries the strings which are, in turn, fastened to the head of the string instrument. The body of the string instrument is the resonance box.

A by far simpler known embodiment of a wall holder for guitars, bass guitars and the like is a rack having two support arms projecting away from the wall between which the neck of the string instrument can be inserted. After the string instrument has been lowered, the head, which usually has a widening in comparison to the neck, rests on the support arms. In this case, it is important that the support arms adjoin the neck of the string instrument as closely as possible, so that the head and thus the instrument can not slip out of the mounting.

It is generally desirable if a wall holder can be used for several different string instruments; for example, for various guitars or bass guitars, but also for a fiddle, a violin, a ukulele, a banjo or similar string instruments. However, just with respect to guitars or bass guitars of various manufacturers or different models, the dimensions of the instrument neck and head already vary greatly. Therefore, for a flexible use, i.e. for the use of a wall holder for different string instruments, it is necessary that the wall holder can be adapted to various dimensions.

DE 195 07 681 C2 discloses a guitar wall holder which can be used for instruments of different neck widths. The guitar wall holder comprises a mounting case that can be fastened to the wall and on which two support arms are fastened which protrude in the manner of a fork with two prongs and form a seat for a guitar head, at least one support arm being arranged on the mounting case so as to be movable in direction of the other support arm. The movable support arm is supported on the mounting case with an end piece of an angular lever section which is pivotable about its longitudinal axis extending in direction of the wall and can be turned about said axis with a rotating motion.

The support arms can be adapted to various neck diameters by means of this construction. Friction-increasing means between the support arm and the mounting case are to ensure that the support arm remains in the assumed position. The support arm is first set by hand, so that the instrument neck can be easily inserted. The support arms are then moved toward one another by the weight of the instrument. In addition, the support arms can be slightly inclined toward one another, so that the instrument is prevented from slipping out.

The effect that the support arms remain in a set position due to the friction-increasing means can also be disadvantageous. This is true, in particular, if the guitar wall holder according to DE 195 07 681 C2 is to be used alternately for instruments having very large dimensions and instruments with very small dimensions. The desired aperture width is then first set by hand in most cases before the instrument can be inserted. However, often, the musician does not have a free hand when storing or putting them away since he is transporting several instruments or accessories at the same time.

Furthermore, the instrument can also get caught when being removed, above all, if the support arms are also slightly inclined. For example, during removal, the support arms can be carried along upward and again be brought very close together there, so that they lock the instrument in.

It is now the object of the invention to provide a wall holder for musical instruments in which the aforementioned disadvantages of the prior art are at least partially overcome and at least reduced.

SUMMARY OF THE INVENTION

This object is solved by the wall holder for musical instruments having the following features.

The wall holder for at least one musical instrument having a neck or a similar taper, in particular a guitar or bass guitar, comprising a mounting which is fastened or can be fastened to the wall and at least two support elements which are situated on the mounting and between which the neck of the musical instrument can be inserted, the neck and/or the head of the musical instrument abutting against the support elements, is characterized in that the mounting has at least one guide bar bracket for the support elements by means of which the support elements can be moved relative to one another.

If, in the following, only the guitar is mentioned instead of the term musical instruments, then this term is representative for all other musical instruments having a neck or similar taper, in particular, string instruments such as bass guitars, ukuleles, banjos and the like, but also percussion instruments which can be hung or fastened or stored in a similar manner as a guitar on the wall holder.

Therefore, a central idea of the present invention lies therein that the support elements can be moved toward one another and away from one another via the guide bar bracket, however, this can only be done in a defined area which is preset by the guide bar bracket. As a result, the wall holder can accommodate musical instruments having various dimensions with respect to the neck and head. The area in which the distance of the support elements is variable toward one another can be set such that, on the one hand, it comprises as many instrument sizes as possible and, on the other hand, enables a simple insertion and removal of the instruments.

The wall holder is not restricted to two support elements. Several pairs of support elements can be provided on the mounting, so that several musical instruments can be hung up at the same time. The size ranges in which each of the distances of a pair of support elements can be set may be selected as desired, so that the wall holder or parts of the wall holder can be specifically designed for musical instruments of larger or smaller dimensions with respect to neck and head.

The support elements protrude so far from the wall or mounting that the head or neck of a musical instrument can be hung up between the support elements and usually no longer slip out when released. At least one of the support elments is movably mounted on the mounting, so that the distance between the support elements can be changed. For this purpose, the at least one support element is held in a guide unit of the guide bar bracket on its side facing the wall or mounting.

The guide bar bracket can be provided to guide two or more support elements or there is a separate guide bar bracket for each support element. Two support elements each can be moved toward one another via the guide bar bracket or the guide bar brackets, for example, in a horizontal plane. Preferably, however, the support elements can be moved toward one another in direction of action of the force of gravity, i.e. in direction of the base or floor, i.e. in particular also by the weight of the musical instrument held between the support elements or support arms. The advantage of this direction of movement is that the musical instrument brings the support elements together or presses them against the neck and/or head by its own weight and as a result increases the holding force. In this case, it is advantageous if both support elements are movably mounted on the mounting since the support elements can then be aligned so that the musical instrument hangs straight, as a result of which the forces are also uniformly distributed on the neck or head of the musical instrument.

Advantageous embodiments and further developments of the wall holder according to the invention can be found described herein.

In an especially advantageous embodiment according to the invention, a separate guide bar bracket is provided for each support element. Two guide bar brackets are then arranged adjacent to one another on the mounting. The guide bar bracket generally comprises a guide rail in which the support element is led. The guide rail can be either mounted on the mounting and detachably or firmly connected with it or be configured as an elongated opening in the mounting. In this connection and also in the following, firmly connected means the item is made as one piece or the noted part, in this case the guide rail, is soldered, welded or otherwise connected with the rest of the item, so that it can not be separated from it without destroying it.

The guide rails are preferably arranged so as to converge in direction of the base on the same level beside one another, so that the support elements are uniformly pressed together by the weight of the suspended musical instruments. In this case, the angle of inclination of the guide rails to the horizontal can be the same or different. For example, it is also possible that one of the two rails is inclined by 90° from the horizontal and the other has any other inclination desired from the horizontal.

On the other hand, a common guide bar bracket for two support elements can, for example, be U-shaped or V-shaped, a support element each being placed in a side of the U or V. In order to be able to define the range of movement of the support elements, appropriate stoppers can be attached to the sides of the U or V. An even better clamping effect can be obtained if the sides of the V-shaped guide bar bracket have a curvature to the vertical median axis of the V. In other words, if one considers the sides of the guide bar bracket as a curve, this means the sides have, with respect to their values, the greatest incline of the tangent at their lowest point in direction of action of the force of gravity or at the point at which the distance of the sides is the smallest, whereby one side has a negative incline and the second side a positive incline.

If several pairs of support elements are to be arranged in a common guide bar bracket on the wall holder, then the guide bar bracket may essentially have an undulated or jagged form, a wave or point each can advantageously have the previously described geometric forms.

In particular, it is advantageous if the guide bar brackets comprise at least one pair of guide grooves converging in direction of the force of gravity. The area in which the distance of the support elements can be varied vis-à-vis one another, can then be set, for example, in such a way that the support elements do not come in contact at any point, but are always at a distance from one another. The advantage of this is that the musical instruments can always be easily inserted into the wall holder, even with one hand, since even the minimum distance can generally be expanded by appropriate positioning of the musical instrument. Also the danger of getting caught in the wall holder is reduced if the support elements can not come into contact at any point since, when the musical instrument is removed, e.g. by a slight lift, the distance between the support elements can only be enlarged which also facilitates the process.

The guide grooves are preferably curved, in particular essentially following the form of a quadrant. In this case, it is especially advantageous if the curved guide grooves of a pair of guide grooves are aligned such that the incline of a tangent in a point of the curve of the respective guide groove at which the two guide grooves have the smallest distance to one another (usually, the outermost point of the guide grooves in direction of the force of gravity), is relatively greater than the incline of the tangent in all other points of the curvature of the guide groove and that the inclines of the tangents in the two points of the smallest distance have different signs. When viewing the mounting from the top, a left guide groove is preferably curved to the left and a right guide groove is curved to the right. The curvature can also be described such that the tangents on the guide grooves at the lowest point of the guide grooves in direction of the force of gravity or at the point at which the distance of the guide grooves to one another is the smallest has the smallest angle to a vertical axis extending between the guide grooves, whereby the angles must have different signs or directions of rotation.

This alignment of the curvatures has the advantage that the distances between the support elements can be set in very fine increments and that an even better clamping effect can be obtained.

In particular, it is advantageous if fastening means are provided to fasten the support elements to the mounting. It is thereby important that the support elements are movably held in the guide groove by the fastening means.

In a simple embodiment of the wall holder according to the invention, the aperture width of the guide groove can be larger than or equal to the smallest diameter of the support element, so that the support element can be partially led through the guide groove in direction of the wall. On the side facing the wall, the support element could, for example, be fastened to the guide groove with fastening means which comprise a widening formed on the support element or a fastening element connected with the support element, e.g. a plate or circular disk or a right parallelepiped having a greater diameter than the aperture width of the guide groove.

In another embodiment, the aperture width of the guide groove can be smaller than the smallest diameter of the support element. Advantageously, the support element is then fastened to the mounting via fastening means which comprise a guide element which is situated in the guide groove and is firmly or detachably connected with the support element on the side facing the room or the side of the mounting facing away from the wall. On the side of the mounting facing the wall, the guide element can have a formed widening having a larger diameter than the aperture width of the guide groove or be connected with fastening means, e.g. a plate or circular disk or a right parallelepiped having a larger diameter than the aperture width of the guide groove. The guide element can also have the form of a bracket which is led through the guide groove and firmly or detachably connected with the support element on its one end and movably mounted in the mounting with its other end.

In an especially advantageous embodiment according to the invention, the mounting is configured as a hollow pot or hollow box having a firmly or detachably connected cover on the side facing away from the wall. It is especially advantageous if the hollow pot or hollow box is open on the side facing the wall. As a result, the mounting is relatively light and can also be very easily mounted. The mounting can then simply be screwed together with the wall from the front, the screws being led, for example, through openings in the cover or through flanges attached to the side wall of the mounting. In addition, the hollow pot or hollow box can have a firmly or detachably connected base on the side facing the wall. As a result, the wall holder is more stable.

In an advantageous embodiment, the guide bar bracket is formed on the cover of the mounting. As a result, there is sufficient space in the hollow pot or hollow box for the means to fasten the support element to the mounting and for means to fasten the mounting to the wall.

In an especially useful embodiment of the wall holder according to the invention, the support elements are covered with a non-slip material. For example, a plastic cover with a high static friction coefficient can be used as a non-slip material, the plastic being preferable expanded. The advantage of a non-slip layer of this type is that the surface of the guitar neck or head is simultaneously protected, e.g. against scratching on the rigid support elements. Rubber or textile fabrics can be used as further coating materials for the support elements.

Basically, the shape of the support elements can be selected as desired, as long as they are suitable for supporting the musical instruments without damaging them. However, usually, the support elements have a longish, preferably cylindrical shape. The support elements can thereby also be simply designed or repeatedly curved.

It is especially advantageous if the support elements have an incline from the horizontal, away from the wall, in opposition to the direction of the force of gravity, which is maximum 10°. This is to prevent the guitar head from slipping out of the wall holder away from the wall. If the guitar begins to slip, it is rather moved toward the wall due to the incline. The incline is preferably selected between 2° and 8°, so that the guitar or the guitar head or guitar neck does not perhaps get caught when being taken out and the insertion into the wall holder is not made more difficult. The support elements can have a widening on their end facing away from the mounting as additional security against the musical instruments slipping out. The widening can, for example, be almost in the form of an attached ball, cone or a plate.

It is also especially advantageous if the support elements are pivoted about an axis of rotation on the mounting. If the support elements are inclined or curved, the distance between the support elements can be even further reduced or enlarged by rotation of the support elements.

The support elements can be designed so that they can moved in the guide grooves independent of one another. However, it is especially advantageous if a translating device is provided which converts the movement of one support element into a movement of a second support element. In this case, in a simple embodiment, only the movement in the guide bar bracket, e.g. the shifting of a support element, can be transmitted to the second support element. In this way, it can, for example, be attained that the two support elements are always at the same level in the horizontal and the musical instruments are thus held at a right angle to the floor, whereby the holding forces also act uniformly on the instrument.

However, it is also possible to transmit a rotational movement of one support element to the second support element by the translation device, so that e.g. both support elements rotate in opposite direction. This is advantageous if the support elements have an incline or curvature. On the one hand, this can result therein that the support elements, when moved in direction of the force of gravity, are moved even closer to one another due to the rotation with their ends facing away from the wall and thus partially surround the guitar neck in order to secure it even further. On the other hand, for example, it can also be obtained by the transmission of the rotational movement that the inclined or curved support elements do not turn in such a way when moved in the curved guide grooves that they surround the neck of the musical instrument, but that the incline always remains constant in its angle and in its direction, as a result of which it is prevented that the musical instrument becomes caught.

In an especially useful embodiment of the wall holder, restoring elements are provided which return the support elements into a preset initial position after the musical instrument has been removed. This enables a very simple insertion or hanging of various musical instruments of different dimensions.

It is especially advantageous if the support elements have a spacer, e.g. in the form of a widening, on the side facing the mounting. Due to this widening, an additional distance between the guitar neck and the wall is then created, so that the sensitive parts of the guitar head can not come in contact with the wall and/or mounting, even if the guitar head is inclined vis-à vis the guitar neck.

In an especially useful embodiment of the wall holder, a locking unit is placed on at least one of the support elements. The locking unit prevents the instrument from falling out of the wall holder with a very high security. The locking unit is preferably a bracket pivoted on the side of a support element facing away from the mounting and reaching to the second support element. For a secure locking, the bracket can have a recess with which it at least partially surrounds the second support element. The bracket can then also be movable on the support element. A further possibility for the locking mechanism is to make a recess in the second support element in which the bracket can engage.

BRIEF DESCRIPTION OF THE DRAWINGS

The invention will be described in greater detail in the following with reference to embodiments and the attached drawings, each showing in a schematic representation.

Parts and values corresponding to one another are provided with the same reference numbers in FIGS. 1 to 4.

DESCRIPTION OF THE INVENTION

Figure 1:
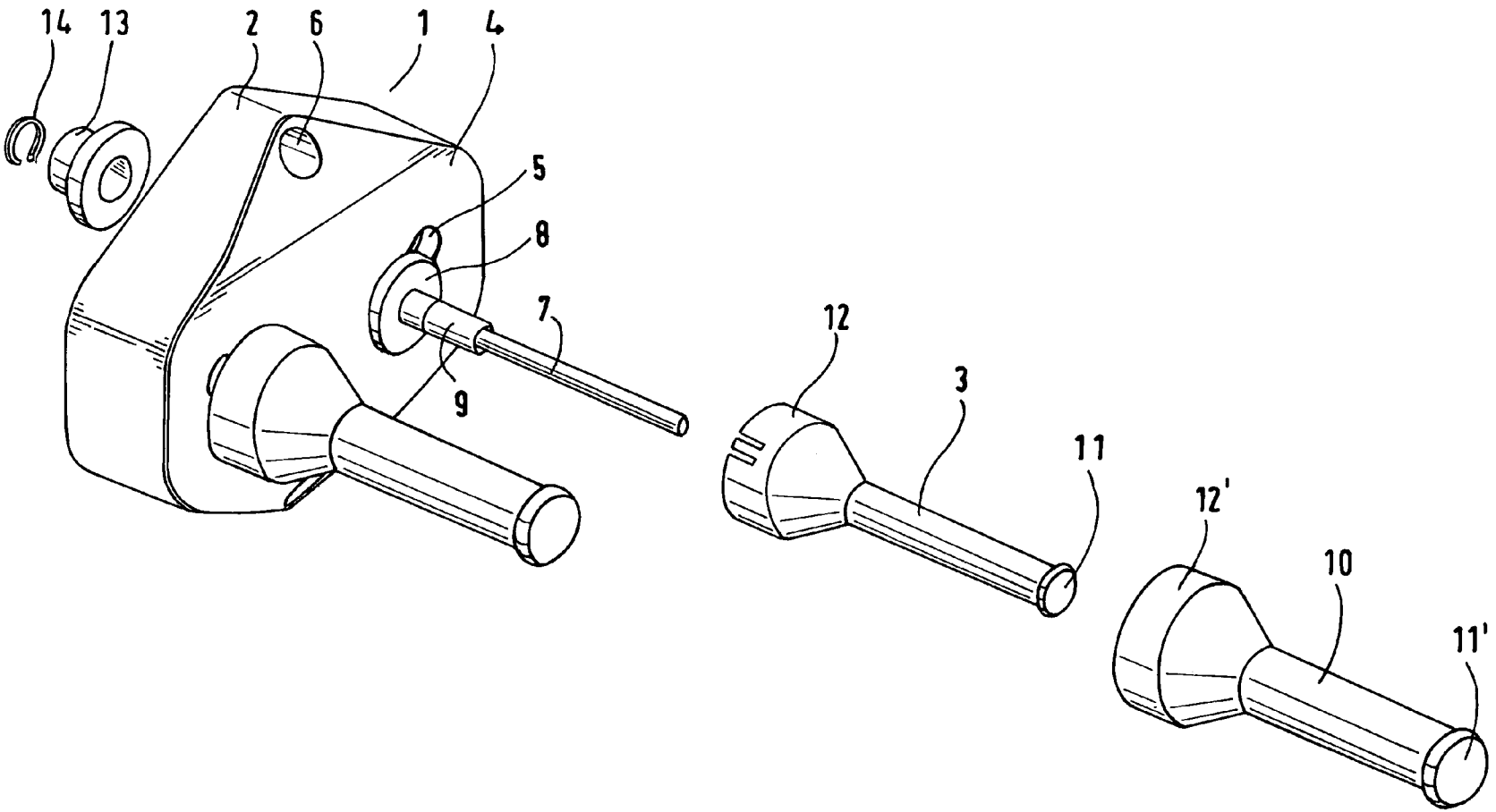
FIG. 1 an exploded drawing of an advantageous embodiment of a wall holder according to the invention, FIG. 2 a perspective view of the front of the wall holder according to FIG. 1 with suspended guitar, FIG. 3 a side view of the wall holder according to FIG. 2, FIG. 4 a rear view of the wall holder according to FIG. 1.

FIG. 1 shows the individual parts of an advantageous embodiment of a wall holder 1 according to the invention for string instruments such as guitars and the like. The wall holder 1 comprises a mounting 2 and two support elements 3. The mounting 2 is designed as a hexagonal hollow box, and a cover 4 is firmly connected with the side walls of the hollow box. Guide grooves 5 are made in the cover 4, said guide grooves almost having the form of quadrants. In this case, the left groove of the guide grooves 5 is bent to the left in the drawing and the right guide groove 5 is bent toward the right. In addition to the guide grooves 5, the cover 4 has additional openings 6 through which screws can be led for fastening the mounting 2 to the wall.

Furthermore, the wall holder 1 comprises fastening means with guide elements 7 which are led through the guide grooves 5 and detachably connected with it at their ends facing the support element 3. The support elements 3 are mounted on the part of the guide elements 7 protruding from the guide groove 5, so that they reach up to the cover 4. To fasten the guide elements 7 in the support elements 3, sleeves 9 are provided. The sleeves 9 are preferably made of a material having a high static friction coefficient, e.g. rubber, and are pulled over the guide elements 7 so that the material layer is pressed in between the inner wall of the support element 3 and the guide elements 7 after the guide elements 7 have been inserted and they can no longer slip out of the support elements 3. End plates 8 are placed on the guide elements 7 as a seal for the support elements 3 in direction of the cover. On the side of the cover 4 facing the wall, fastening elements 13 in the form of a sleeve or cap are placed on the guide elements 7 which have a larger diameter on the side facing the cover 4 than the aperture width of the guide grooves 5. The fastening elements 13 are secured with spring lock washers 14, so that they can not slip off the guide elements 7.

A coating 10, which preferably consists of a non-slip material, is applied to the support elements 3, so that a guitar suspended in the wall holder 1 is prevented from slipping out. In addition, the coating 10 can have the function of protecting the guitar against damage at the contact surfaces, e.g. scratching by the rigid support elements 3. The coatings 10 can, for example, be made of soft materials such as plastics, preferably foamed, rubber, textile fabrics or also felt.

On the ends facing away from the mounting 2, the support elements 3 and coatings 10 can have a widening 11, 11' which are to offer additional security against a suspended guitar slipping out. On the ends facing the mounting, the support elements 3 and coatings 10 have spacers 12, 12'. The spacers 12, 12' are configured as an enlargement of the diameter of the support element 3 with a sloping transition to the area having a smaller diameter, so that an almost truncated cone form is produced.

The cover 4 of the mounting 2 is provided with a layer consisting of a smooth, slidable material on the side facing away from the wall, so that the support elements 3 or the end disk 8 can be very easily guided over the cover 4. As a result, the support elements 3 can be easily adjusted.

Figure 2:
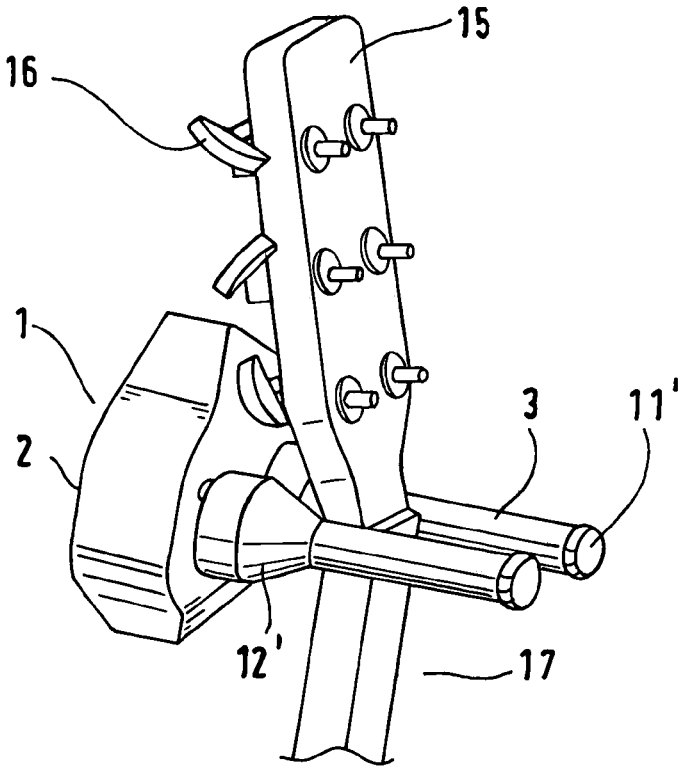
Figure 3:
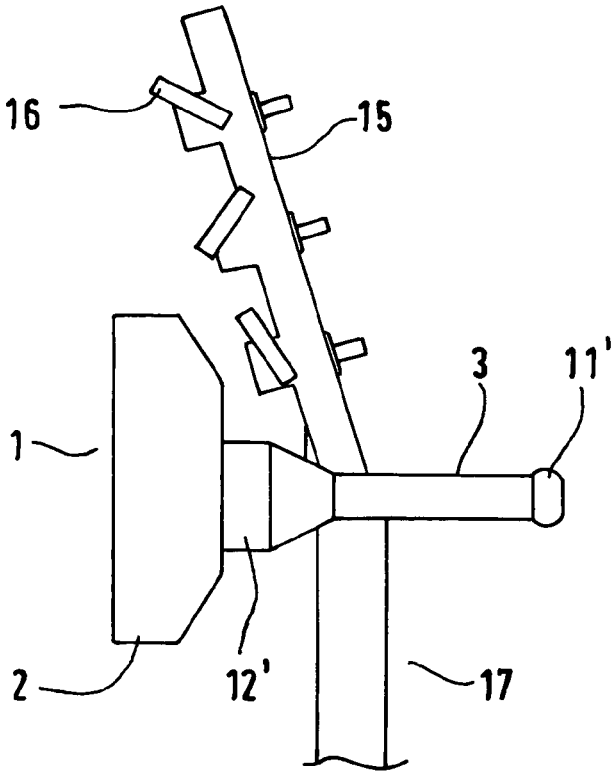

It is clear from FIG. 2 that the spacers 12, 12' prevent a guitar head 15 of a guitar 17 suspended in the wall holder 1 from coming into contact with the wall (not shown here) or with the mounting 2, so that e.g. a tuning mechanism 16 can not be damaged or moved due to the suspension. In addition, the spacers 12' ensure that the distance to the wall and to the mounting 2 is so great that a guitar 17 having an inclined guitar head 15 can also be suspended in the wall holder 1 without coming into contact with the wall and mounting 2 (see also FIG. 3).

Figure 4:
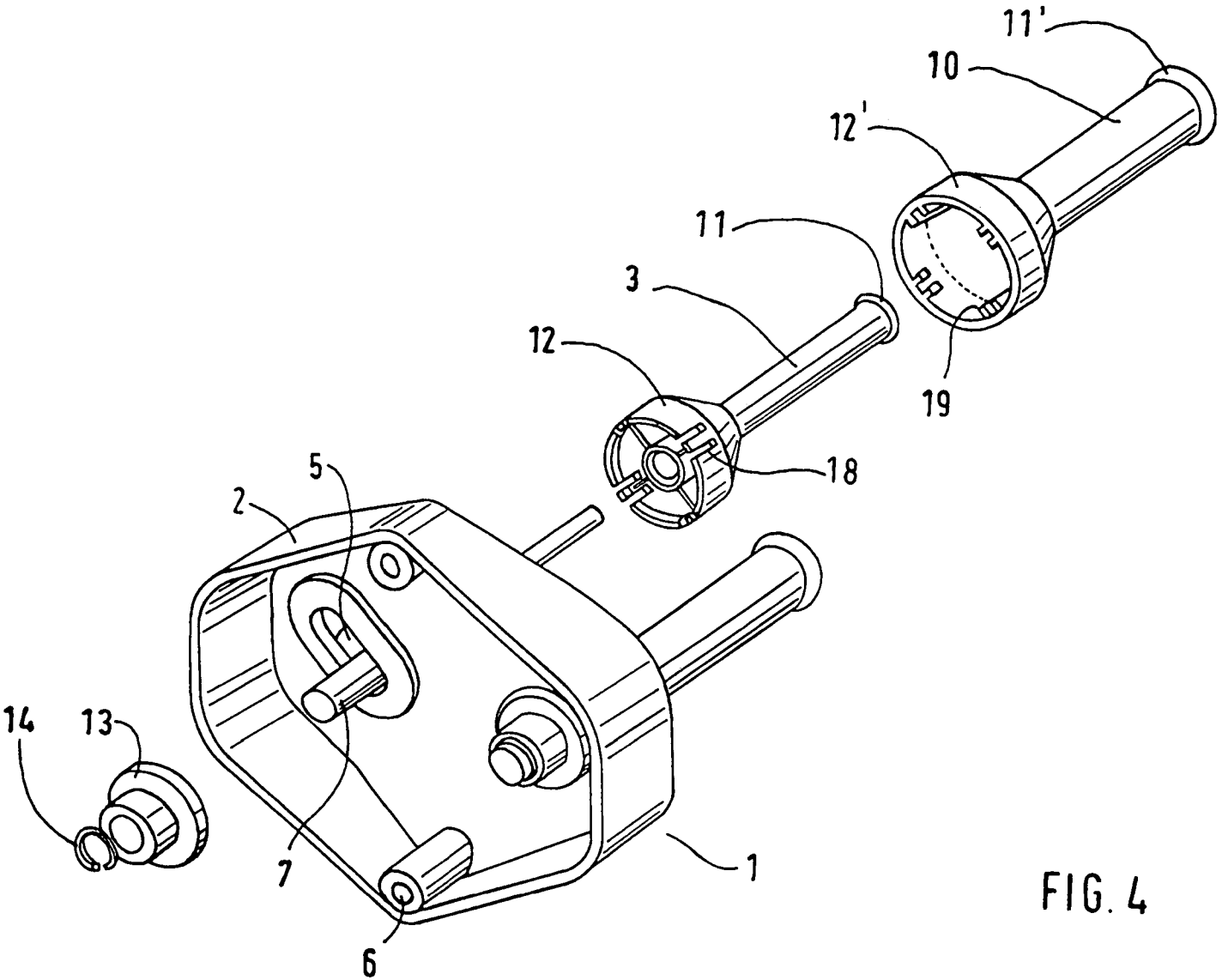

FIG. 4 shows the rear view of the wall holder 1. It can be seen in the drawing how the guide elments 7 are fastened inside the mounting 2. The guide elements 7 protrude through the guide grooves 5 into the interior of the mounting 2. The fastening elements 13 are mounted on the guide elements 7 and secured with spring lock washers 14, so that they can not slide off the guide elements 7.

Figure 5:
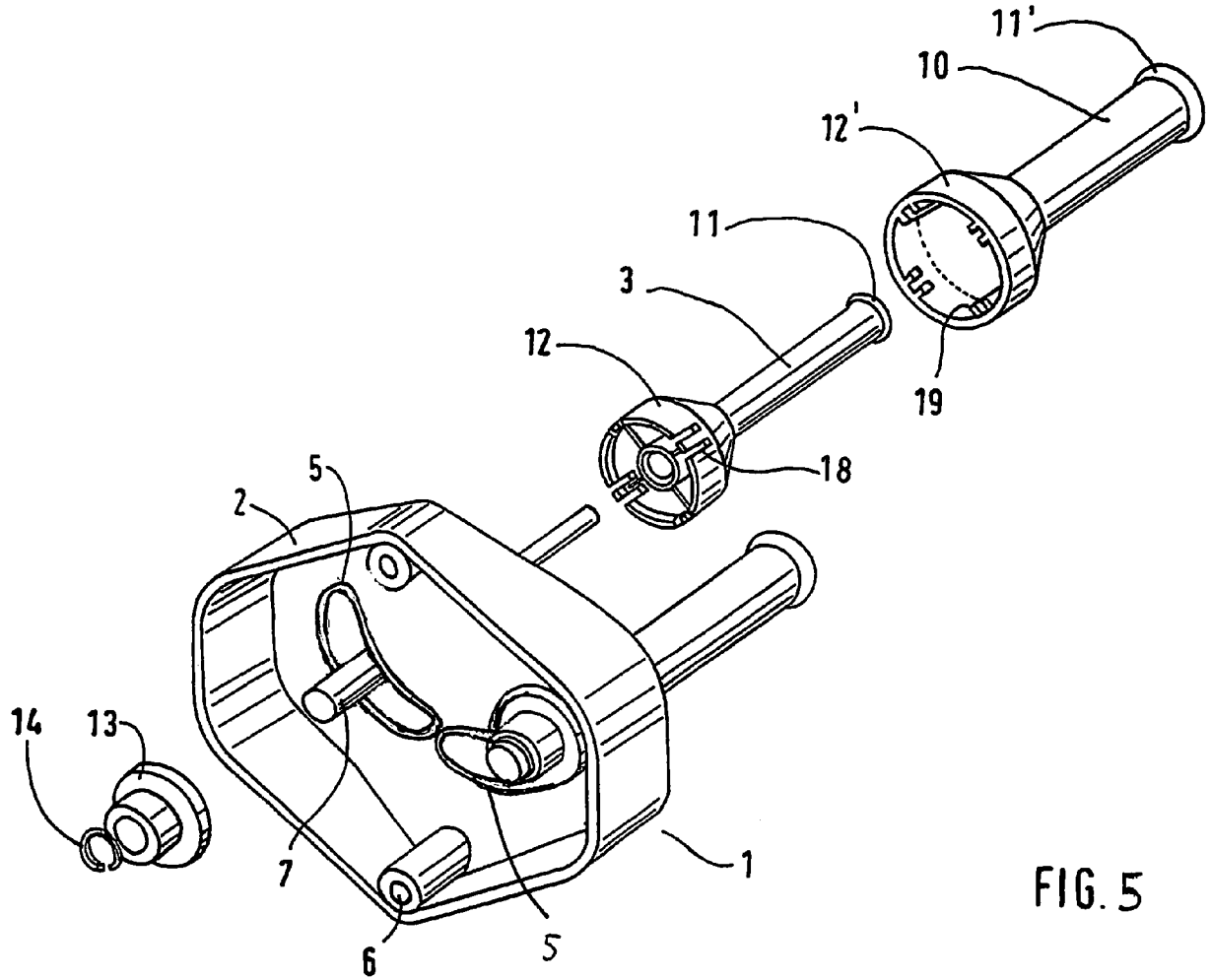
FIG. 5 a rear view of the wall holder having grooves arranged in the U-shaped configuration.

FIG. 5 illustrates a rear view of the wall holder 1 having guide grooves 5 that are arranged in the U-shaped configuration. FIG. 5 shows how the guide elements 7 are fastened inside the mounting 2. The guide elements 7 protrude through the guide grooves 5 into the interior of the mounting 2. The fastening elements 13 are mounted on the guide elements 7 and secured with spring lock washers 14, so that they can not slide off the guide elements 7.

It can also be seen in FIG. 4 how the coatings 10 are fastened to the support elements 3. The support elements 3 have eight recesses 18 on the ends facing the mounting 2, said recesses being distributed equidistantly about the periphery. The coatings 10 have corresponding protrusions 19 on the ends facing the mounting 2 which engage in the recesses 18. This prevents the coatings 10 from slipping down.

The invention claimed is:

1. A wall holder for at least one musical instrument having one of a neck and a similar taper, in particular one of a guitar and a bass guitar, comprising:

a mounting which is operable to be fastened to a wall and at least two support elements which are arranged on the mounting said support elements which can be inserted between those of the neck of the musical instrument, and at least one of the neck and the head of the musical instrument abutting against the support elements;

wherein the mounting has at least one guide bar bracket for the support elements via which the support elements can be moved relative to one another;

wherein the guide bar bracket comprises at least one pair of elongated guide grooves converging in direction of the force of gravity;

wherein the guide grooves are curved, substantially in a form of a quadrant; and wherein the curved guide grooves of a pair of guide grooves are aligned in such a way that an incline of a tangent in a point of a curvature of the respective guide groove at which the two guide grooves have a slightest distance from one another is greater than an incline of a tangent in all other points of the curvature of the guide groove and that the inclines of the tangents have different signs in the two points of the slightest distance.

2. A wall holder for at least one musical instrument having one of a neck and a similar taper, in particular one of a guitar and a bass guitar, comprising:

a mounting which is operable to be fastened to a wall and at least two support elements which are arranged on the mounting said support elements which can be inserted between those of the neck of the musical instrument, and at least one of the neck and the head of the musical instrument abutting against the support elements;

wherein the mounting has at least one guide bar bracket for the support elements via which the support elements can be moved relative to one another; and wherein the mounting is configured as one of a hollow pot and a hollow box with one of a firmly and a detachably connected cover on a side facing away from the wall which preferably has the guide bar bracket.

3. A wall holder for at least one musical instrument having one of a neck and a similar taper, in particular one of a guitar and a bass guitar, comprising:

a mounting which is operable to be fastened to a wall and at least two support elements which are arranged on the mounting said support elements which can be inserted between those of the neck of the musical instrument, and at least one of the neck and the head of the musical instrument abutting against the support elements;

wherein the mounting has at least one guide bar bracket for the support elements via which the support elements can be moved relative to one another; and wherein a translating device is provided which translates a movement of one support element into a movement of a second support element.

4. A wall holder for at least one musical instrument having one of a neck and a similar taper, in particular one of a guitar and a bass guitar, comprising:

a mounting which is operable to be fastened to a wall and at least two support elements which are arranged on the mounting said support elements which can be inserted between those of the neck of the musical instrument, and at least one of the neck and the head of the musical instrument abutting against the support elements;

wherein the mounting has at least one guide bar bracket for the support elements via which the support elements can be moved relative to one another; and wherein restoring elements are provided for resetting the support elements into an initial position after the musical instrument has been removed.

* * * * *